US005718006A

United States Patent [19]

Dixon

[11] Patent Number: 5,718,006

[45] Date of Patent: Feb. 17, 1998

[54] FLUID DISPENSER

[75] Inventor: Aubrey Lawrence Dixon, 55 Oakfield Gardens, Edmonton, London N18 1NY, United Kingdom

[73] Assignee: Aubrey Lawrence Dixon, London, England

[21] Appl. No.: 581,915

[22] Filed: Jan. 2, 1996

[30] Foreign Application Priority Data

Jan. 3, 1995 [GB] United Kingdom ..... 9500267

[51] Int. Cl.[6] ..... E03D 9/03

[52] U.S. Cl. ..... 4/227.2; 4/227.4; 137/101.25

[58] Field of Search ..... 4/225.1, 227.1, 4/227.2, 227.4; 137/101.25, 101.27

[56] References Cited

U.S. PATENT DOCUMENTS

| | | | |
|---|---|---|---|
| 1,161,029 | 11/1915 | Cooney | 4/227.2 |
| 1,866,164 | 7/1932 | Hughes et al. . | |
| 2,021,110 | 11/1935 | Strattman | 4/227 |
| 2,071,655 | 2/1937 | Purrmann | 4/225 |
| 2,600,937 | 6/1952 | Strattman | 222/358 |
| 3,241,718 | 3/1966 | Kemper | 222/57 |
| 3,890,657 | 6/1975 | Gray | 4/225.1 |
| 5,205,000 | 4/1993 | Xia et al. | 4/402 |

FOREIGN PATENT DOCUMENTS

| | | | |
|---|---|---|---|
| 2 584 795 | 1/1987 | France . | |
| 48049 | 12/1888 | Germany . | |
| 27 19 478 | 1/1978 | Germany . | |
| 61-287990 | 12/1986 | Japan . | |
| 15398 | 10/1889 | United Kingdom | 4/227.4 |
| 15645 | 2/1910 | United Kingdom . | |
| 311114 | 9/1929 | United Kingdom . | |
| 332984 | 7/1930 | United Kingdom . | |
| 343190 | 2/1931 | United Kingdom . | |
| 394569 | 6/1933 | United Kingdom . | |
| 521368 | 5/1940 | United Kingdom . | |
| 1134355 | 5/1967 | United Kingdom . | |

*Primary Examiner*—Henry J. Recla
*Assistant Examiner*—Charles R. Eloshway
*Attorney, Agent, or Firm*—Armstrong, Westerman Hattori, McLeland & Naughton

[57] ABSTRACT

An apparatus is provided for dispensing fluid into a cistern such as a cistern on a water-closet, toilet or urinal. The apparatus comprises a receptacle (1) to be mounted in position within the cistern (not shown). A pivoted scoop (5) is mounted to move pivotally about trunnions (6). The pivoted scoop (5) is provided with a ladle (7) for collecting fluid (31) from the cistern and a trough (8) for dispensing the fluid (31) collected by the ladle (7) into the cistern. The scoop (5) is also provided with holes (13) for draining fluid (31) from the trough (8) as fluid (31) is collected by the ladle (7). A float (14) is connected to one end of the scoop (5) to cause the scoop (5) to pivot and dispense fluid (31) whenever the cistern is emptied. The float (14) is provided with a first cavity (21) for forming an air pocket in the float (14) and a second cavity (20) which allows water (28) provided in the cistern to enter and weigh down the float (14).

14 Claims, 3 Drawing Sheets

FLUID DISPENSER

THE PRESENT INVENTION relates to a fluid dispenser, and, more particularly, to a fluid dispenser adapted to dispense fluid into the cistern of a water-closet or toilet or into a corresponding cistern provided on a urinal.

It is known to provide various devices to add a bleach or disinfectant or equivalent material to water contained within the cistern of a water-closet or toilet or the cistern of a urinal.

For example, it has been proposed to suspend, within the cistern, a block of material which has a low solubility. Whenever the cistern is full, the block of material will tend to dissolve into the cistern. This has the disadvantage that, if the cistern remains un-operated for a long period of time, a considerable quantity of the block may dissolve, which is wasteful.

It is also know to use complex containers with various siphonic or convoluted flow passages to permit the ingress and egress of water into the containers. Typically, these containers also contain a solid material which dissolves gradually over the course of time and, although the problem found with the simple block of material is reduced, nevertheless the problem still exists.

In order to help alleviate this problem, it has been proposed to provide a fluid dispenser for use within a cistern which is automatically activated to dispense a fluid whenever the cistern is utilised. Such automatic dispensers typically comprise a receptacle which is mounted in the cistern, a pivotable scoop which allows liquid to be scooped up from the receptacle and then discharged into the cistern and a float connected to one end of the scoop which rises and falls with the level of water in the cistern and which causes the scoop to pivot whenever the cistern is empty.

However, various disadvantages are associated with this type of cistern. For example, an automatic dispenser of the type described above dispenses fluid whenever the cistern is utilised so that fluid is present in the "U-bend" of the water closet, toilet or urinal whenever the cistern is flushed. In this way, the water-closet, toilet or urinal is always exposed to the fluid which is dispensed by the fluid dispenser. Accordingly, it is desirable to be able to dispense into the cistern a measured aliquot of fluid each time the cistern is utilised. However, in the prior art dispensers, the amount of fluid dispensed into the cistern will depend on the amount of fluid in the receptacle, so that large amounts of fluid are scooped out of the receptacle when the receptacle is full and only small amounts of fluid are scooped out of the receptacle when the receptacle is nearly empty. Such an arrangement is, therefore, inefficient and wastes the particular fluid being used.

Also, it is necessary for the float to move upwards and downwards with the level of water in the cistern in order to cause the pivoting movement of the scoop to dispense fluid into the cistern. Thus, the float not only needs to float in the water in the cistern so that the scoop falls back into the receptacle as the water level of the cistern rises, but the float must also be heavy enough to move downwards with the level of the water as the cistern is emptied, in order to pivot the scoop and dispense fluid into the cistern. Thus, it is also desirable to provide a float which is not only light enough to float and heavy enough to fall with the level of the water in the cistern, but which is also inexpensive to produce.

According to one aspect of the present invention, there is provided an apparatus for dispensing a fluid into a cistern, which apparatus comprises means for mounting the apparatus in a cistern, a receptacle for containing fluid to be dispensed into the cistern and a moveable scoop adapted to move, in use, in response to actuation of the cistern, between a first position, in which fluid is collected from the receptacle, and a second position, in which fluid is dispensed into the cistern, wherein the scoop comprises a ladle for collecting an aliquot of fluid in the first position, a channel for dispensing fluid from the ladle into the cistern in the second position and means for draining fluid from the channel when the scoop is in the first position and until the scoop is in the second position. With this arrangement, only the fluid scooped up by the ladle is dispensed into the cistern, with most of the fluid scooped up by the channel escaping via the draining means. Thus, in this way, substantially equal aliquots of fluid may be discharged into the cistern each time the cistern is activated and a minimum amount of fluid is wasted.

Preferably, the scoop is actuated in response to movement of a pivoted handle or pivoted element forming part of a flushing mechanism.

Conveniently, the scoop moves in response to movement of a float within the cistern. In one embodiment, the scoop is pivotally mounted on the receptacle and the float is directly connected to the pivoted scoop so that movement of the float causes pivotal movement of the scoop.

Preferably, the channel comprises a first end and a second end. The ladle is provided in an elevated position at the first end of the channel, the draining means comprises an aperture provided between the ladle and the first end of the channel and fluid is dispensed into the cistern via the second end of the channel.

Preferably, the channel comprises a base and a pair of upstanding side walls, the ladle comprises a base of substantially V-shaped cross section, the lower part of the V-section being connected to the base of the channel and the aperture comprises a pair of triangular holes provided between the V-sectioned base of the ladle and the base and upstanding side walls of the channel.

According to another aspect of the present invention, there is provided an apparatus for dispensing a fluid into a cistern, which apparatus comprises means for mounting the apparatus in a cistern, a receptacle for containing fluid to be dispensed into the cistern and a moveable scoop adapted to move, in use, in response to movement of a float within the cistern, to scoop up fluid from the receptacle and dispense the fluid into the cistern, wherein the float comprises a first cavity which allows liquid provided in the cistern to enter the float and a second cavity for forming an air pocket when the float is suspended in the liquid provided in the cistern. The cavity which forms an air pocket enables the float to float in the water contained in a cistern, whilst the cavity which allows water to enter the float from the cistern provides the weight required for the float to move downwards with the level of the water as the cistern empties, thereby causing movement of the scoop to dispense fluid from the receptacle to the cistern.

Preferably, the first cavity opens towards the upper surface of the float and the second cavity opens towards the lower surface of the float.

More preferably, the float is formed from a unitary moulding of plastics material. Thus, a float having the desired properties of being light enough to float in the water of the cistern, yet heavy enough to fall with the level of the water as the cistern empties can be manufactured by a relatively inexpensive process.

Also provided are a float and a scoop for use with the above apparatus and a cistern containing the above apparatus.

According to a further aspect of the present invention, there is provided a method for dispensing a fluid into a cistern, which method comprises mounting in a cistern a receptacle containing fluid, providing a scoop having a ladle and a channel, actuating the scoop to move, in response to actuation of the cistern, between a first position, in which an aliquot of fluid is collected by the ladle and a second position, in which fluid is dispensed from the ladle into the cistern via the channel, and draining fluid from the channel when the scoop is in the first position, and until the scoop is in the second position.

According to another aspect of the present invention, there is provided a method of dispensing a fluid into a cistern, which method comprises mounting a receptacle containing fluid in a cistern, providing a moveable scoop having a float attached thereto, moving the scoop, in response to movement of the float within the cistern, to scoop up fluid from the receptacle and to dispense the fluid into the cistern, which method further comprises the step of providing the float with a first cavity to allow liquid provided in the cistern to enter the float and a second cavity for forming an air pocket when the float is suspended in the liquid provided in the cistern.

In order that the invention may be more readily understood and so that further features thereof may be more readily appreciated, the invention will now be described, by way of example only, with reference to the accompanying drawings, in which.

Figure 1:
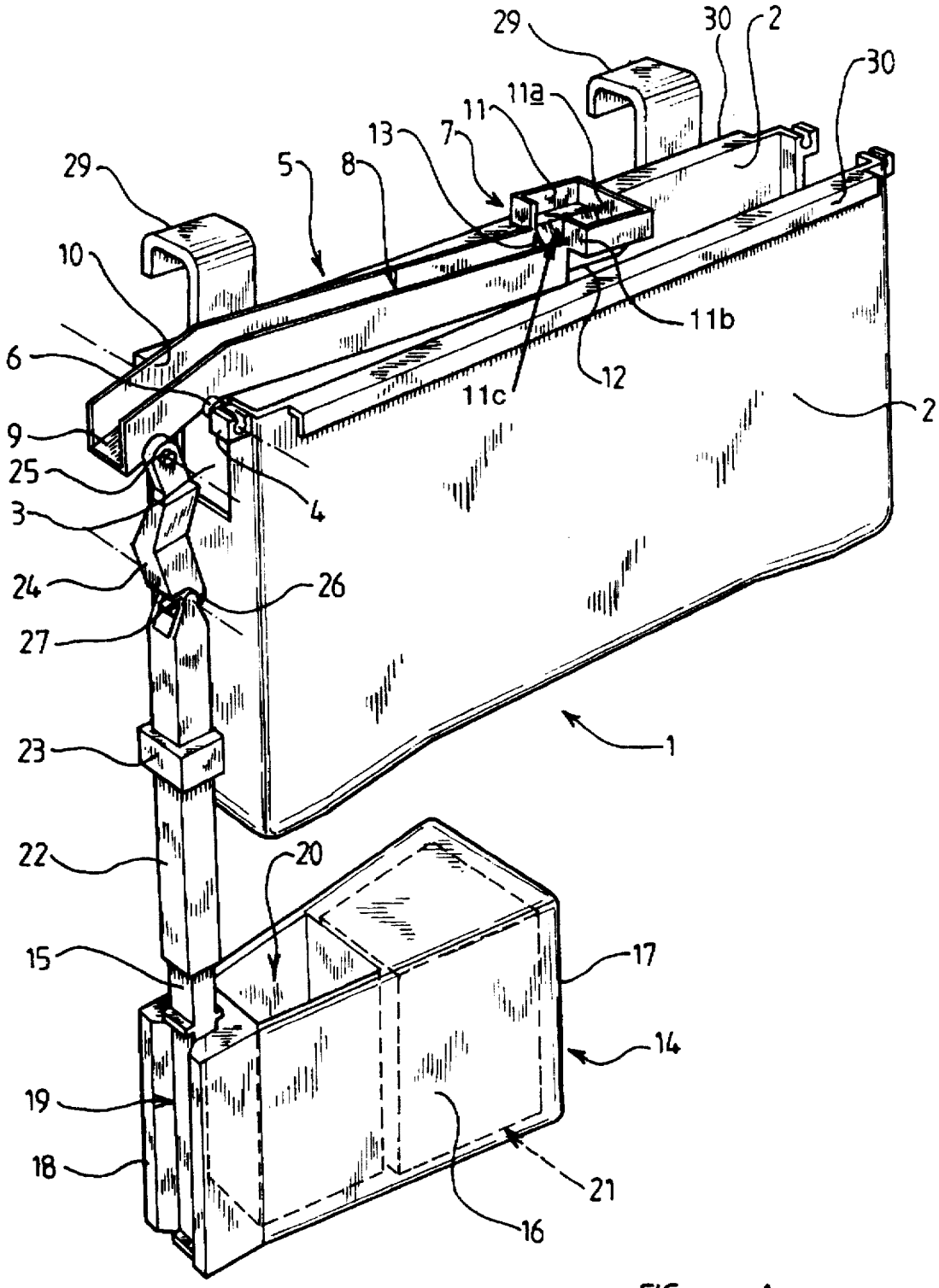
FIG. 1 is a perspective view of an embodiment of a fluid dispenser according to the present invention.
Figure 3:
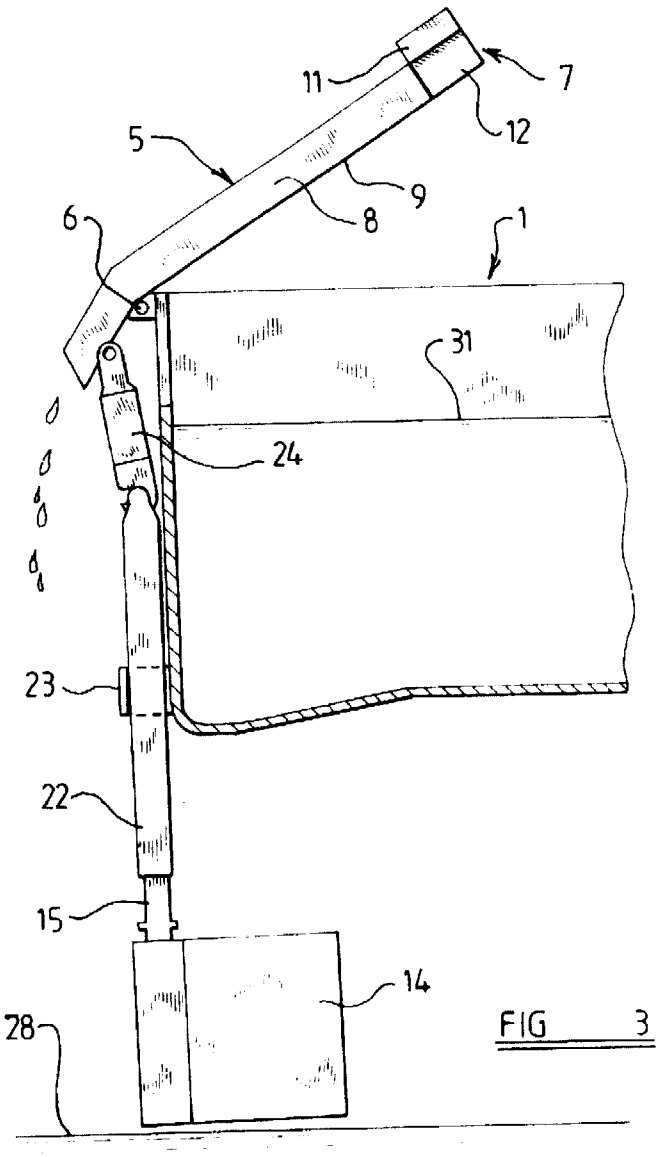
FIG. 3 is a partly cut away side view corresponding to FIG. 2, illustrating the apparatus in an alternate condition.
Figure 2:
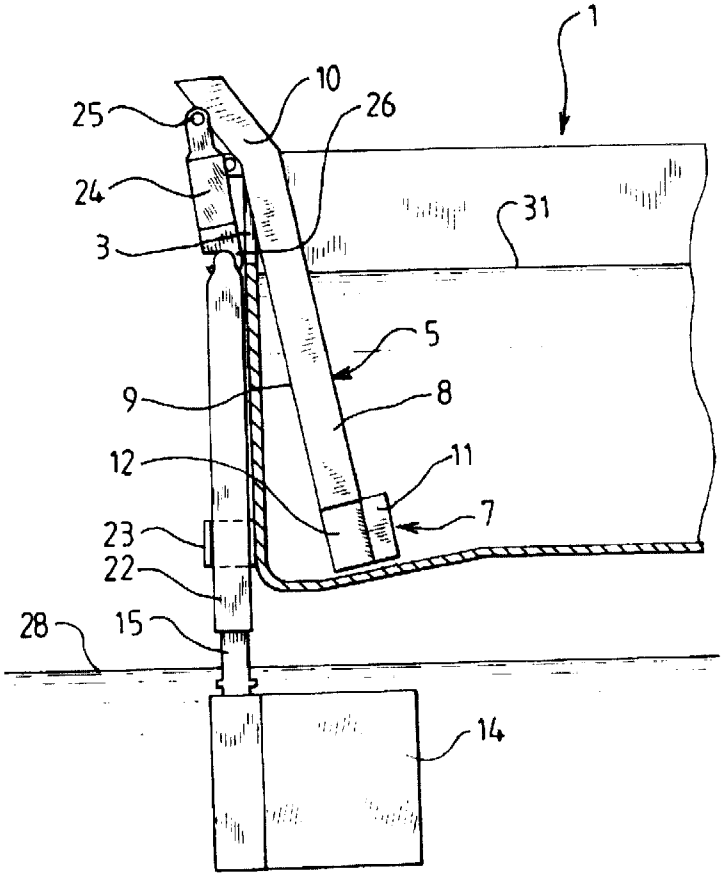
FIG. 2 is a partly out away side view of the embodiment of FIG. 1 illustrating the apparatus in one condition.

Referring to FIGS. 1 to 3, the embodiment of the fluid dispenser shown in the drawings comprises a receptacle 1 for the fluid comprising a bottom wall (not shown) and upstanding side walls 2. The receptacle 1 may be closed, but the example illustrated is open-topped.

One side wall 2 of the receptacle 1 is provided with a cut-out 3 adjacent the open top and a pair of parallel U-shaped flanges 4, on either side of the cut-out 3, which extend outwardly from the side wall 2.

An elongate scoop 5 is provided which is pivotally mounted on the side wall 2 adjacent the cut-out 3 by means of a pair of trunnions 6 which extend outwardly from the elongate scoop 5, one either side of the elongate scoop 5, and which are located within the U-shaped flanges 4.

Figure 4:
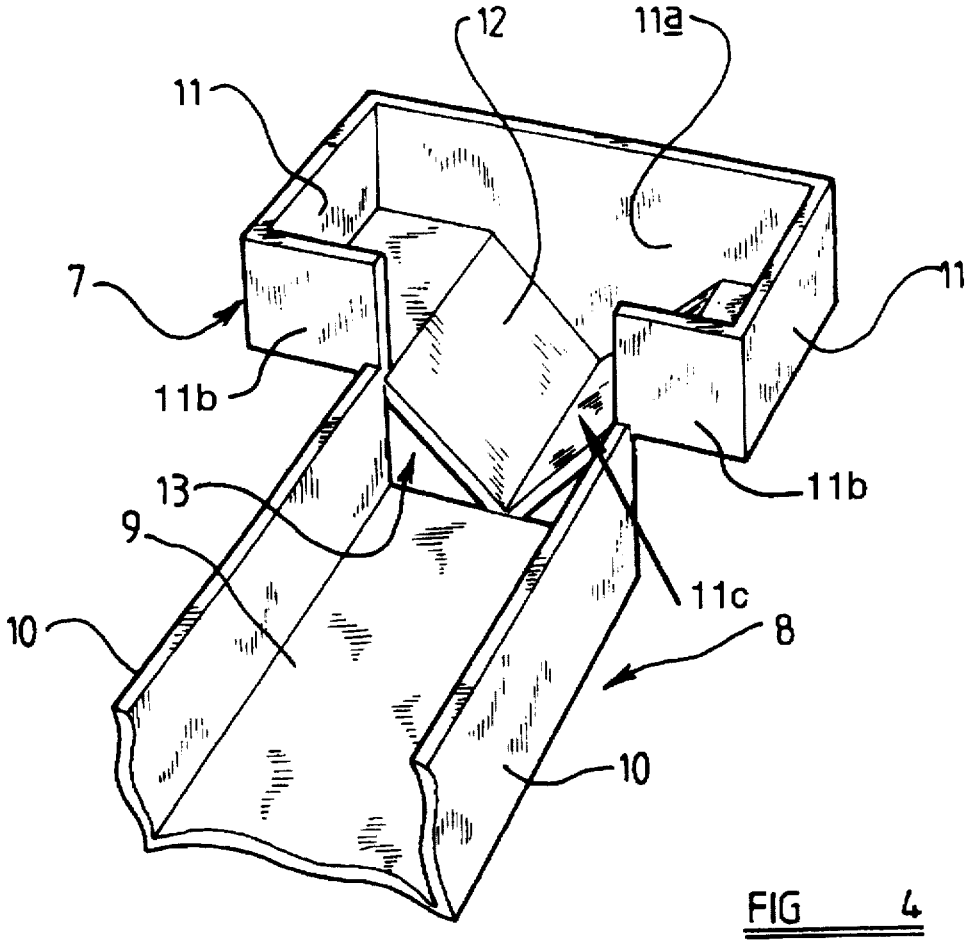
FIG. 4 is a perspective view of one end of the scoop shown in FIG. 1.

The scoop 5, in the form illustrated, and which can be seen in more detail in FIG. 4, comprises a ladle 7 and a channel section or trough 8. The trough 8 has an elongate base 9, upstanding longitudinal side walls 10 and an open top. One end of the trough 8 adjacent the trunnions 6 extends through the cut-out 3 and beyond the side wall 2 of the receptacle 1 (see FIG. 1). This end of the trough 8 is open and slopes downwardly outwardly from the main part of the trough 8.

The other end of the trough 8 opposite the open end is connected to the ladle 7. The ladle 7 has two parallel upstanding side walls 11, an end wall **11*a* perpendicular to the side walls 11 and two front walls 11*b*, opposite and parallel to the end wall 11*a*. The two front walls 11*b* define a gap, 11*c* therebetween which leads into the trough 8. The lower ends of each front wall 11*b* adjacent the gap 11*c* are formed integrally with the upper edges of the side walls 10 of the trough 8. The ladle 7 further comprises a base 12 having two substantially flat horizontal portions formed integrally with the upstanding side walls 11 of the ladle 7 and a portion of substantially "V"-shaped cross-section between the two substantially flat horizontal portions. The V-section portion of the base 12 slopes inwardly, downwardly from the flat horizontal portions at an angle to the side walls 10 of the trough 8 and the lower-most point of the V-section portion of the base 12 at the open end of the ladle 7 is integrally formed with the base 9 of the trough 8. In this arrangement, a pair of triangular holes 13 are provided at the end of the trough 8 connected to the ladle 7, between the side walls 10 of the trough 8 and the inwardly, downwardly sloping V-section portion of the base 12 of the ladle 7**.

In the embodiment shown in the drawings, a float 14 is also provided and is connected to the open end of the trough 8 of the scoop 5 by means of a rigid rod 15.

The float 14 can be seen in detail in FIG. 1. The float 14 is substantially wedge-shaped, with side walls 16 sloping inwardly from a first end wall 17 of larger cross-section to an opposing end wall 18 of smaller cross section. The end wall 18 of smaller cross section has an indent 19 formed along the length thereof.

The float 14 is also provided with a pair of cavities or cells 20, 21. One cavity 20 is located adjacent the end wall 18 of smaller cross section and opens towards the upper surface of the float 14, whilst the other cavity 21 is located adjacent the end wall 17 of larger cross section and opens towards the lower surface of the float 14. The float 14 shown in the drawings is formed from a unitary mounting of plastics material and is thus relatively cost-effective to manufacture.

The rigid rod 15 connecting the float 14 to the scoop 5 is substantially flat and the lower end of the rod 15 snap-fits into the indent 19 provided in the end wall 18 of smaller cross section in the float 14. The upper part of the rod 15 is provided with an outer casing 22, which outer casing 22 passes through a guide 23 connected to the side wall 2 of the receptacle 1 containing the cut-out 3. The guide 23 shown in the drawings comprises a substantially rectangular ring.

As can be seen from FIG. 1, the open end of the trough 8, which slopes downwardly, outwardly from the main part of the trough 8 and extends beyond the side wall 2 of the receptacle 1 is connected to the uppermost part of the rod casing 22 by means of a bent linkage portion 24. The open end of the trough 8 and the upper part of the rod casing 22 are each pivotally connected to opposite ends of the bent linkage portion 24. A pin 25 provided on one side of the trough 8 adjacent the open end which pin 25 is located within a corresponding hole provided at one end of the bent linkage portion 24 and a hook 26 provided at the other end of the bent linkage portion 24 hooks onto a bar 27 provided on the uppermost part of the rod casing 22. Such an arrangement provides a crank-mechanism which enables the float 14 and the rod 15 to move upwards and downwards with the level of water 28 provided in a cistern, smoothly and efficiently, along an axis substantially parallel to the axis of the side wall 2 of the receptacle 1 containing the cut-out 3, thereby causing the scoop 5 to pivot between the positions shown in FIGS. 2 and 3 smoothly and with minimum effort.

The receptacle 1 is also provided with a pair of mounting brackets 29, to enable the receptacle 1 to be suspended within a cistern of a water-closet, toilet or urinal. The mounting brackets 29 shown in the drawings are detachable from a rim provided around the outer edge of the upper part of the upstanding side walls 2 of the receptacle 1.

FIG. 2 shows the receptacle 1 mounted in position within a cistern (not shown), when the cistern is substantially full of water 28. When the cistern is substantially full of water 28, the float 14 experiences an up-thrust, thus tending to pivot the scoop 5 to the position illustrated in FIG. 2 in which the ladle of the scoop is below the level of a fluid 31 provided in the receptacle 1. The lower cavity 21 in the float 14 forms an air pocket which enables the float 14 to experience upthrust more effectively in the water 28 in the cistern.

When the water-closet, toilet or urinal (not shown) is flushed, water 28 drains out of the cistern. The float 14 no longer experiences an up-thrust due to the effect of the water 28 but, instead, experiences a downward pull caused by gravity. The float 14 is further weighed down by water 28 Which is present in the upper cavity 20 in the float 14, thereby enhancing the downward pull experienced by the float 14.

The mass of the float 14, together with the mass of the water in the upper cavity 20 of the float, is such that the downward pull effectively causes the scoop 5 to pivot about the trunnions 6 so that the ladle 7 of the scoop 5 is lifted up above the level of the fluid 31 in the receptacle 1, with the open end of the trough 8 at a position below the position of the ladle 7.

As the scoop 5 moves from the position shown in FIG. 2 to the position shown in FIG. 3, fluid 31 in the receptacle 1 is caught within the trough part 8 of the scoop 5 and the ladle part 7 of the scoop 5. Whilst the position of the ladle 7 is below the position of the open end of the trough 8, fluid 31 will flow along the trough 8 towards the ladle 7 and out of the trough 8 through the triangular holes 13 provided between the ladle 7 and the upstanding side walls 10 of the trough 8. This will continue until the position of the ladle 7 rises above the position of the open end of the trough 8. At this point, the fluid 31 retained in the ladle 7 flows back into the trough 8 and is discharged into the cistern from the open end of the trough 8 as a series of drops (see FIG. 3). Because only the fluid 31 scooped up by the ladle 7 is discharged into the cistern and most of the fluid 31 scooped up by the trough 8 has already escaped through the triangular holes 13, the scoop 5 will discharge a substantially equal aliquot of fluid 31 into the cistern each time the water-closet, toilet or urinal is flushed, irrespective of the amount of fluid 31 in the receptacle 1.

The fluid 31 discharged into the cistern is actually discharged into the water 28 as it drains out of the cistern, so that the final part of the water 28 draining out of the cistern will contain a solution of the fluid 31 which has been discharged from the receptacle 1. It is this final solution which remains in the "U-bend" of the water-closet, toilet or urinal (not shown). The fluid 31 contained in the receptacle 1 may be a bleach, detergent, antiseptic, fragrant or anti-lime-scale liquid or any other suitable material. The above mentioned materials may alternatively be added to water provided in the receptacle in the form of an effervescent tablet (not shown), which fizzes as it dissolves in the water.

Once the contents of the ladle 7 have been discharged into the cistern, the cistern will begin to fill with water 28 again. As the level of water 28 shown in FIG. 3 begins to rise, the level of water 28 will eventually reach the lower surface of the float 14. As the level of water 28 reaches the lower surface of the float 14, an air pocket is created in the lower cavity 21 of the float 14. As explained above, this enables the float 14 to experience upthrust more effectively in the water 28 in the cistern. The float 14 will then, accordingly, rise with the level of the water 28, thereby pivoting the scoop 5 from the position shown in FIG. 3 to the position shown in FIG. 2. Because of the rigid nature of the rod 15, once the scoop 5 has reached the position shown in FIG. 2, with the scoop 5 resting on the bottom of the receptacle 1, the float 14 will no longer rise with the still rising level of the water 28 in the cistern. The level of the water 28 in the cistern continues to rise above the upper surface of the float 14 until the cistern is full. Water will, therefore, enter the upper cavity 20 in the float 14, thus, weighing down the float 14 so that the float 14 can more easily fall with the level of the water 28 as the cistern empties so that the Whole cycle can be repeated.

Not only the float 14, but also the entire fluid dispenser may be made of a plastics material which means that the fluid dispenser shown in the drawings can be relatively inexpensive to manufacture.

Whilst the invention has been described with reference to embodiments which are operated by means of a float 14, the float 14 rising and falling with the level of water 28 within the cistern, it is to be appreciated that other embodiments of the invention may be adapted to be operated directly in response to actuation of the flushing mechanism. A typical flushing mechanism involves the actuation of a pivoted handle. It is, thus, envisaged that there could be a direct link between the pivoted handle (not shown) and the pivoted scoop 5 so that, on actuation of the pivoted handle, the pivoted scoop 5 executes a pivotal motion, thus discharging a measured aliquot of fluid 31 from the receptacle 1 into the cistern.

It is also envisaged that, whilst embodiments of the invention may be provided to be temporarily mounted within a cistern, other embodiments may be devised which are permanently mounted in position. If a receptacle in accordance with the invention is mounted permanently in position, the cistern may be provided with a "viewing glass" (not shown) on the exterior thereof to enable the level of fluid 31 present within the receptacle 1 to be readily observed. Also a filling spout (not shown), readily accessible on the exterior of the cistern, to enable easy filling of the receptacle 1, may be provided.

What is claimed is:

1. An apparatus for dispensing a fluid into a cistern, which apparatus comprises means for mounting the apparatus in a cistern, a receptacle for containing fluid to be dispensed into the cistern and a moveable scoop adapted to move, in use, in response to actuation of the cistern, between a first position, in which fluid is collected from the receptacle, and a second position, in which fluid is dispensed into the cistern, wherein the scoop comprises in combination, a ladle for collecting an aliquot of fluid in the first position and a channel for dispensing fluid from the ladle into the cistern in the second position the channel comprising an elongate base and upstanding longitudinal side walls, the ladle comprising side walls and a base, the ladle being mounted at the first end of the channel, the ladle being in an elevated position with the base of the ladle being located above the base of the channel, and at least one aperture being defined between the ladle and the first end of the channel, the ladle being positioned to collect an aliquot of fluid when the scoop is in the first position, the channel being located for dispensing fluid from the ladle into the cistern when the scoop is in the second position, the said at least one aperture comprising means for draining fluid from the channel when the scoop is in the first position, and for draining fluid from the channel until the scoop is in the second position.

2. An apparatus according to claim 1, wherein the scoop moves in response to movement of a float within the cistern.

3. An apparatus according to claim 2 wherein the float comprises a first cavity which allows liquid provided in the cistern to enter the float, in use, and a second cavity which forms, in use, an air pocket when the float is suspended in the liquid provided in the cistern.

4. An apparatus according to claim 3, wherein the first cavity opens towards an upper surface of the float and the second cavity opens towards a lower surface of the float.

5. An apparatus according to claim 4, wherein the float is formed from a unitary moulding of plastics material.

6. An apparatus according to claim 4, wherein the float is directly connected to the pivoted scoop so that movement of the float causes pivotal movement of the scoop.

7. An apparatus according to claim 1 wherein the scoop is pivotally mounted on the receptacle.

8. An apparatus according to claim 7 wherein the scoop moves in response to movement of a float within the cistern and the float is directly connected to the pivoted scoop so that movement of the float causes pivotal movement of the scoop.

9. A cistern including an apparatus as defined in claim 1.

10. A method of dispensing a fluid into a cistern, which method comprises mounting in a cistern a receptacle containing fluid, providing a scoop having a ladle and a channel, the channel comprising an elongate base and upstanding longitudinal side walls, the ladle comprising side walls and a base, the ladle being mounted at the first end of the channel, the ladle being in an elevated position with the base of the ladle being located above the base of the channel, at least one aperture being defined between the ladle and the first end of the channel, the ladle being positioned to collect an aliquot of fluid when the scoop is in the first position, the channel being located for dispensing fluid from the ladle into the cistern when the scoop is in the second position, the said at least one aperture comprising means for draining fluid from the channel when the scoop is in the first position, and for draining fluid from the channel until the scoop is in the second position, actuating the scoop to move, in response to actuation of the cistern, between a first position, in which an aliquot of fluid is collected by the ladle and a second position, in which fluid is dispensed from the ladle into the cistern via the channel, and draining fluid from the channel when the scoop is in the first position, and until the scoop is in the second position.

11. A method according to claim 10, wherein the scoop is pivoted between the first and second positions.

12. A method according to claim 11, further comprising the step of directly connecting a float to the pivoted scoop so that movement of the float causes pivotal movement of the scoop.

13. A method of dispensing a fluid into a cistern, which method comprises mounting a receptacle containing fluid in a cistern, providing a moveable scoop having a float attached thereto said scoop having a ladle and a channel, the channel comprising an elongate base and upstanding longitudinal side walls, the ladle comprising side walls and a base, the ladle being mounted at the first end of the channel, the ladle being in an elevated position with the base of the ladle being located above the base of the channel, at least one aperture being defined between the ladle and the first end of the channel, the ladle being positioned to collect an aliquot of fluid when the scoop is in the first position, the channel being located for dispensing fluid from the ladle into the cistern when the scoop is in the second position, the said at least one aperture comprising means for draining fluid from the channel when the scoop is in the first position, and for draining fluid from the channel until the scoop is in the second position, moving the scoop in response to movement of the float within the cistern, to scoop up fluid from the receptacle and to dispense the fluid into the cistern, which method further comprises the step of providing the float with a first cavity to allow liquid provided in the cistern to enter the float and a second cavity for forming an air pocket when the float is suspended in the liquid provided in the cistern.

14. An apparatus for dispensing a fluid into a cistern, which apparatus comprises means for mounting the apparatus in a cistern, a receptacle for containing fluid to be dispensed into the cistern and a moveable scoop adapted to move, in use, in response to actuation of the cistern, between a first position, in which fluid is collected from the receptacle, and a second position, in which fluid is dispensed into the cistern, wherein the scoop comprises a ladle for collecting an aliquot of fluid in the first position, a channel, the channel comprising a first end and a second end, a base and a pair of upstanding side walls, for dispensing fluid from the ladle into the cistern in the second position, the ladle provided in an elevated position at the first end of the channel and comprising a base and a pair of upstanding side walls, the ladle comprising a base of substantially V-shaped cross section, the lower part of the V-section being connected to the base of the channel and apertures comprising a pair of triangular holes provided between the V-sectioned base of the ladle and the base and upstanding side walls of the channel, which comprise means for draining fluid from the channel when the scoop is in the first position, and until the scoop is in the second position with fluid from the ladle being dispensed via the second end of the channel.

* * * * *